United States Patent [19]

Sugiyama

[11] 4,430,055

[45] Feb. 7, 1984

[54] SEMI-CONTINUOUS VACUUM HEAT-TREATING FURNACE, AND ITS OPERATION PROCESS

[76] Inventor: Michio Sugiyama, 7-21, Takamoridai 3-chome, Kasugai-shi, Aichi-ken, Japan

[21] Appl. No.: 349,672

[22] Filed: Feb. 17, 1982

[30] Foreign Application Priority Data

Feb. 17, 1981 [JP] Japan ..... 56-21826

[51] Int. Cl.[3] ..... C21D 1/74; C21D 1/06; F27D 3/00; F27B 5/04

[52] U.S. Cl. ..... 432/11; 266/250; 266/252; 373/112; 373/115; 432/18; 432/205

[58] Field of Search ..... 432/18, 19, 26, 205, 432/209, 11; 266/250, 252; 373/110, 112, 113, 115

[56] References Cited

U.S. PATENT DOCUMENTS

| | | | |
|---|---|---|---|
| 3,866,891 | 2/1975 | Kalbfleisch | 373/112 |
| 4,118,016 | 10/1978 | Westeren et al. | 266/250 |
| 4,336,412 | 6/1982 | Thomander et al. | 373/110 |

OTHER PUBLICATIONS

"Vacuum Goes High-Production", Jerry Mayfield, American Machinist, Oct.1978.

"Metals Handbook Ninth Edition", vol. 4, Heat Treating.

*Primary Examiner*—J. Camby

*Attorney, Agent, or Firm*—Armstrong, Nikaido, Marmelstein & Kubovcik

[57] ABSTRACT

A semi-continuous vacuum heat-treating furnace of two-chambers and one-door type is composed of a vacuum heating chamber which includes a heating element and a heat insulation material, both being stable in chemical property and strength in vacuum condition and atmospheric pressure at high temperature, a cooling chamber which is associated with the vacuum heating chamber, and an intermediate vacuum door which separates the vacuum heating chamber and the cooling chamber from each other. Operation process of the heat-treating furnace comprises steps of entering a first substance to the vacuum heating chamber in atmospheric pressure and heating it at vacuum condition, transferring the heated first substance to the cooling chamber and cooling it under pressure, entering a second substance to the vacuum heating chamber simultaneously with the cooling step of the first substance and then heating the second substance at vacuum condition, and discharging the first substance within the cooling chamber out of the furnace.

3 Claims, 3 Drawing Figures

SEMI-CONTINUOUS VACUUM HEAT-TREATING FURNACE, AND ITS OPERATION PROCESS

BACKGROUND OF THE INVENTION (1) Field of the Invention

The present invention relates to semi-continuous vacuum heat-treating furnace, and more particularly to a semi-continuous vacuum heat-treating furnace which is composed of two chambers, a vacuum heating chamber and a cooling chamber, and an intermediate vacuum door to separate both chambers from each other, and its operation process.

(2) Description of Prior Art

Batch type heat-treating furnaces of hot wall style and cold wall style have been conventionally utilized for a vacuum heat-treating furnace. However, these furnaces have disadvantages in (1) that if heated substance surface, heating element and heat insulation material are not cooled to a temperature at which oxidation does not occur, heated substance cannot be discharged out of the furnace and subsequent substance to be heated cannot be charged into the furnace, and (2) that most of heating energy required to heat substance to a prescribed temperature is dissipated to raise temperature of heat insulation substance and a furnace floor.

In order to eliminate above mentioned disadvantages, a semi-continuous vacuum heat-treating furnace of three-chambers and two-doors type was developed. As shown in FIG. 1, the heat-treating furnace comprises a heating chamber B including a heating element B1 and a heat insulation material B2 and for heating a substance M at vacuum condition or low-pressure condition, a preparation chamber A disposed at forward side of the heating chamber B, a cooling chamber C having a cooling fan E and disposed at rear side of the heating chamber B, first and second intermediate vacuum doors G, H for separating above mentioned three chambers A, B, C from each other, a charging door F and a carriage door I.

The substance M heated to a high temperature in the heating chamber B is transferred through the second intermediate vacuum door H opened to the vacuum cooling chamber C. After closing the door H, the cooling chamber C is evacuated into low-pressure condition and then the substance M is cooled by means oil quenching or non-oxidizing gas such as nitrogen or argon. After the preparation chamber A is evacuated into vacuum condition, the first intermediate door G is opened and successive substance M is transferred to the vacuum heating chamber B at high temperature. In this constitution, waiting time for heating the substance M is significantly reduced and the heating chamber B can be always held in vacuum condition of high temperature. Accordingly, this constitution is superior to conventional batch type in working ratio, thermal efficiency, productivity and energy saving.

Operation process of above mentioned semi-continuous vacuum heat-treating furnace particularly non-oxidizing gas cooling furnace will now be described referring to Table 1.

The vacuum heating chamber B is previously heated to a prescribed temperature at vacuum condition, the preparation chamber A and the cooling chamber C are held in atmospheric pressure, and the charging door F, the first intermediate vacuum door G, the second intermediate vacuum door H and the carriage door I are all closed.

At the first step, the charging door F is opened, the first substance M1 is entered to the preparation chamber A in atmospheric pressure, and then the charging door F is closed.

At the second step, after evacuating the preparation chamber A into vacuum condition, the first intermediate vacuum door G is opened, the first substance M1 is transferred from the preparation chamber A to the vacuum heating chamber B, and the first intermediate vacuum door G is immediately closed.

At the third step, the first substance M1 is heated to a prescribed temperature in the vacuum heating chamber B and held at the temperature for a prescribed time. The preparation chamber A is restored to atmospheric pressure condition, the charging door F is opened, second substance M2 is entered to the preparation chamber A, and the charging door F is immediately closed and the cooling chamber C is evacuated into low-pressure condition.

At the fourth step, the preparation chamber A is evacuated into vacuum condition, the cooling chamber C at low-pressure condition is made vacuum condition, the second intermediate door H is opened, the first substance M1 at high temperature is transferred from the vacuum heating chamber B to the cooling chamber C, and the second intermediate door H is immediately closed.

At the fifth step, the first intermediate vacuum door G is opened, the second substance M2 is transferred from the preparation chamber A to the vacuum heating chamber B, cooling gas is introduced to the cooling chamber C and stirred by the cooling fan E while the cooling chamber C is restored to low-pressure condition, the first substance M1 is cooled at a prescribed cooling rate until a prescribed temperature is attained, and then the cooling chamber C is restored to atmospheric pressure.

At the sixth step, the carriage door I is opened and the first substance M1 in the cooling chamber C is discharged out of the furnace. At the same time, the second substance M2 is heated to a prescribed temperature in the vacuum heating chamber B and held at the temperature for a prescribed time. On the other hand, the preparation chamber A is restored to atmospheric pressure, the charging door F is opened, the third substance M3 is entered, and then the charging door F is immediately closed.

At the seventh step, operation process is performed in similar manner to the fourth step. Process is repeated in the fourth, first and sixth steps in sequence at normal operation condition.

The semi-continuous vacuum heat-treating furnace of three-chambers and two-doors type which repeatedly performs above mentioned process can obtain above mentioned technical effect. However, the heat-treating furnace of this type inevitably becomes large in length therefore requires large-scale devices in evacuating system and complicated devices in control system and heated substance transferring system. Accordingly, such furnace has disadvantages in high manufacturing cost, long maintenance time and long waiting time for heating the substance.

Soot (carbon powder) produced at vacuum carburizing in this heat-treating furnace cannot be removed by burning and it is gradually deposited to the heating element in the heating chamber. The deposit of soot reduces electric resistance of the heating element and may cause short-circuit fault at the worst case, resulting in stop of operation. Soot adhering to heat insulation substance decreases insulating effect thereof and electric power required for heating increases. In addition, constitution of the heating chamber disposed between the preparation chamber and the cooling chamber makes maintenance of the heating chamber difficult.

SUMMARY OF THE INVENTION

An object of the present invention is to provide a semi-continuous vacuum heat-treating furnace of so-called two-chambers and one-door type, which is composed of two chambers, a vacuum heating chamber and a cooling chamber, and an intermediate vacuum door and holds feature of conventional semi-continuous vacuum heat-treating furnace of three-chambers and two-doors type, and its operation process.

Another object of the invention is to provide a semi-continuous vacuum heat-treating furnace and its operation process, wherein the furnace is short in length and small in size, installation area is decreased, waiting time for heating of substance is short, the number of steps for heat-treating is small, and working ratio is good in comparison to conventional heat-treating furnace of three-chambers and two-doors type.

A further object of the invention is to provide a semi-continuous vacuum heat-treating furnace and its operation process, wherein trouble caused by deposit of soot during vacuum carburizing as in conventional furnace can be eliminated.

The present invention relates to a semi-continuous vacuum heat-treating furnace characterized in that charging and carriage ports formed respectively at forward and rear sides of the furnace are provided with a charging door and a carriage door, a vacuum heating chamber composed of heating element and heat insulation material having stability of chemical property and strength in vacuum and atmospheric pressure at high temperature is formed at forward side of the furnace, a cooling chamber is formed at rear side of the furnace, and the vacuum heating and cooling chambers are separated from each other by an intermediate vacuum door.

The invention also relates to operation process of a semi-continuous vacuum heat-treating furnace, which process comprises steps of entering the first substance to a vacuum heating chamber at atmospheric pressure and then heating it at vacuum condition to a prescribed temperature, moving the heated substance at high temperature to a cooling chamber at vacuum condition, cooling the heated substance under pressure at a prescribed cooling rate, entering the second substance to the heating chamber in atmospheric pressure and then heating it at vacuum condition to a prescribed temperature, raising pressure in the cooling chamber to atmospheric pressure, and discharging the first substance out of the furnace.

BRIEF DESCRIPTION OF THE INVENTION

DESCRIPTION OF THE PREFERRED EMBODIMENT

A heat-treating furnace as a preferred embodiment of the invention and its operation process will now be described referring to the accompanying drawings and tables.

Figure 1:
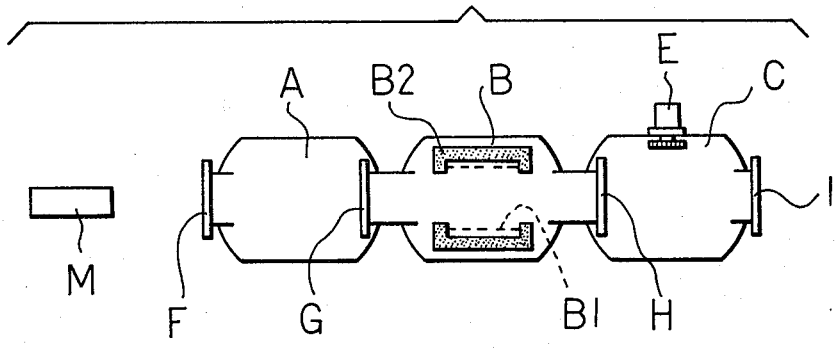
FIG. 1 PRIOR ART
FIG. 1 is a schematic representation of structure of a semi-continuous vacuum heat-treating furnace in prior art.
Figure 2:
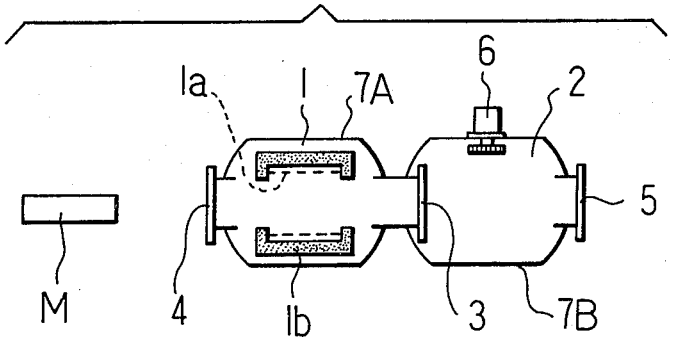
FIG. 2 is a schematic representation of structure of a semi-continuous vacuum heat-treating furnace as an embodiment of the present invention.

In FIG. 2, a semi-continuous vacuum heat-treating furnace comprises a vacuum heating chamber 1 and a cooling chamber 2. A heating element 1*a* of the vacuum heating chamber 1 is preferably a resistor heating element which is strong at high temperature so that it is not oxidized and burned even contacting directly with atmosphere at high temperature, not subjected to thermal crack, and not evaporated even in vacuum condition at high temperature. The resistor heating element may be of silicon-carbide heating element to which recrystallization treating is applied, or silicon-carbide heating element with surface having alumina injection coating film. Furthermore, nickel-chromium alloy heating element or iron-chromium alloy heating element may be used at maximum heating temperature less than 1,000° C. and vacuum pressure of 0.2 Torr.

A heat insulation material 1*b* is preferably that of refractories having small thermal conductivity and being stable chemically even repeatedly subjected to vacuum condition and atmospheric pressure at high temperature, such as ceramic fiber of high purity.

A vessel 7A of the vacuum heating chamber 1 and a vessel 7B of the cooling chamber 2 are separated from each other by means of an intermediate vacuum door 3. Although the intermediate vacuum door 3 is installed within the cooling chamber 2 in this embodiment, it may be installed within the vacuum heating chamber 1. The vacuum heating chamber 1 is provided with a charging door 4 at charging port in order to enter a substance M into the chamber. The cooling chamber 2 is provided with a cooling fan 6 arranged on ceiling of the vessel 7B and with a carriage door 5 at discharge port in order to move the heated substance M out of the furnace. The intermediate vacuum door 3, the charging door 4 and the carriage door 5 are opened or closed rapidly by means of a door opening device (not shown). The vacuum heating chamber 1 is connected with heating power source, vacuum evacuating source and carburizing gas source (not shown); the cooling chamber 2 is connected with vacuum evacuating source and pressurized gas source (not shown).

Above mentioned doors 3, 4, 5, and vessels 7A, 7B are required to be air-tight completely at vacuum condition (less than 0.5 Torr) or under pressure (at least 0.3 Kg f/cm$^2$ or more). Heated substance transferring devices (not shown) are installed in the vacuum heating chamber 1 and the cooling chamber 2 respectively in order to enter, transfer and discharge the heated substance.

Operation process of a semi-continuous vacuum heat-treating furnace of the invention as above constituted, particularly a non-oxidizing gas cooling furnace will be described referring to Table 2.

The vacuum heating chamber 1 is previously heated to a prescribed temperature at atmospheric pressure, the cooling chamber 2 is held in atmospheric pressure, and the charging door 4, the intermediate vacuum door 3 and the carriage door 5 are all closed.

At the first step, the charging door 4 is opened, a first substance M1 is entered to the vacuum heating chamber 1 in atmospheric pressure, and then the charging door 4 is immediately closed.

At the second step, the vacuum heating chamber 1 is evacuated into vacuum condition of less than about 0.5 Torr, and the first substance M1 is heated to a prescribed temperature and held at the temperature for a prescribed time. At the same time, the cooling chamber 2 is evacuated into vacuum condition of less than about 0.5 Torr.

At the third step, the intermediate vacuum door 3 is opened, the heated substance M1 is transferred from the vacuum heating chamber 1 to the cooling chamber 2, and then the intermediate vacuum door 3 is closed.

At the fourth step, inert or non-oxidizing gas from the pressurized gas source is introduced to the cooling chamber 2 which is made pressurized state of at least 0.3 $Kgf/cm^2$, and the heated substance M1 is cooled at a prescribed cooling rate while the inert gas is stirred by means of the cooling fan 6. On the other hand, air is introduced to the vacuum heating chamber 1 which is restored to atmospheric pressure, the charging door 4 is opened, a second substance M2 is entered to the vacuum heating chamber 1, and then the charging door 4 is closed.

At the fifth step, the heating chamber 1 is evacuated into prescribed vacuum condition, the second substance M2 is heated to a prescribed temperature and held at the temperature for a prescribed time. On the other hand, introduction of the gas to the cooling chamber 2 is stopped, the gas is exhausted out of the furnace and the cooling chamber 2 is restored to atmospheric condition, the carriage door 5 is opened, and the first substance M1 is discharged out of the furnace. The carriage door 5 is closed afterwards, and the cooling chamber 2 is evacuated into a prescribed vacuum pressure.

At the sixth step, operation process is carried out in similar manner to the third step. Process is repeated in the third, fourth and fifth step in sequence at normal operation condition.

In operation process of the present invention, when the vacuum heating chamber 1 is restored to atmospheric pressure, high-temperature condition is maintained in the chamber 1. If a substance M is entered to the chamber 1 at such high-temperature condition, thin oxide film may be produced on surface of the substance M. The oxide film, however, is dissociated and evaporated at subsequent vacuum heating thus excellent metal skin is obtained. When gas from the carburizing gas source is introduced to the vacuum heating chamber 1 of the semi-continuous vacuum heat-treating furnace of the invention so as to perform vacuum carburizing, soot (carbon powder) may adhere to the heating element **1*a* and the heat insulation material 1*b* in the vacuum heating chamber 1. When air is introduced to the vacuum heating chamber 1 per operation cycle and the chamber 1 is restored to atmospheric pressure, the soot is burnt out and exhausted out of the furnace thus the chamber 1 is clarified. At the fourth step in operation process of the invention, When the vacuum heating chamber 1 is restored to atmospheric pressure and a substance M is entered, air may invade the cooling chamber 2 and oxidize the heated substance M. In order to eliminate air invasion and oxidation of the substance M, the cooling chamber 2 is pressurized by non-oxidizing gas as above described. In place of cooling process where the heated substance M transferred from the vacuum heating chamber 1 is cooled by means of non-oxidizing gas in the cooling chamber 2 under pressure, the heated substance M** may be immersed within oil (water) tank or rapidly cooled by oil (water) injection.

Figure 3:
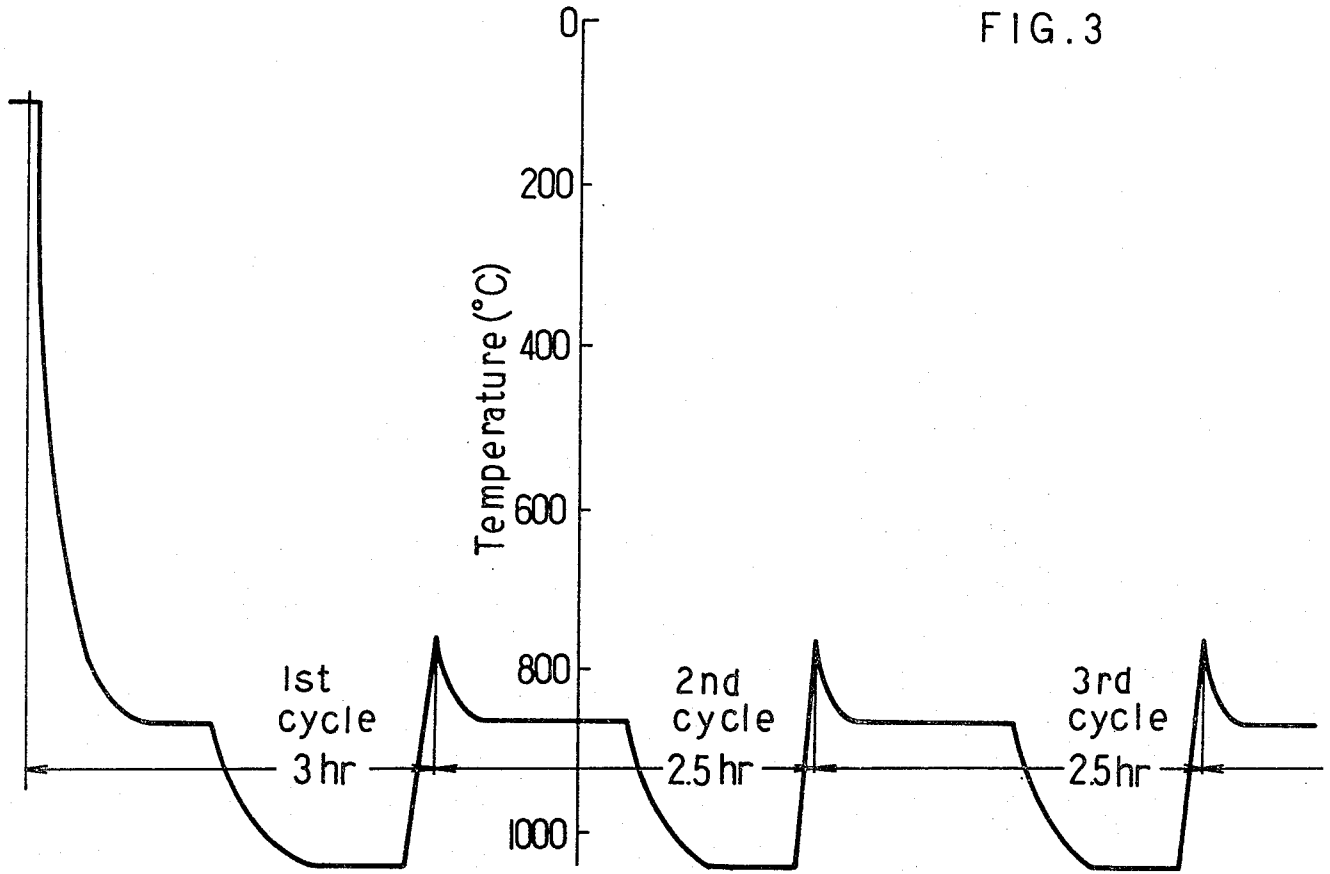
FIG. 3 is a graph illustrating an example of cycle time in operation process of the semi-continuous vacuum heat-treating furnace shown in FIG. 2.

As above described, since a semi-continuous vacuum heat-treating furnace of the present invention does not require a waiting time for heating which is necessary in conventional semi-continuous vacuum heat-treating furnace of three-chambers and two-doors type, cycle time can be reduced to about 2.5 hours at normal state (about 3.5 hours in conventional furnace) as shown in FIG. 3 and cost for heat treating can be significantly decreased. The semi-continuous heat-treating furnace of the invention can be applied to carbo-nitriding, nitriding, and soft nitriding by further connecting nitriding gas source therewith.

TABLE 1

| Step No. | Charging door F | Preparation chamber A | First Intermediate Vacuum door G | heating chamber B | Second intermediate Vacuum door H | Cooling chamber C | Carriage door I |
|---|---|---|---|---|---|---|---|
| 1 | | →[M 1] | | | | | |
| 2 | | [M 1]→ | | →[M 1] | | | |
| 3 | | →[M 2] | | [M 1] | | | |
| 4 | | [M 2] | | [M 1]→ | | →[M 1] | |
| 5 | | [M 2]→ | | →[M 2] | | [M 1] | |

TABLE 1-continued

| Step No. | Charging door F | Preparation chamber A | First Intermediate Vacuum door G | heating chamber B | Second intermediate Vacuum door H | Cooling chamber C | Carriage door I |
|---|---|---|---|---|---|---|---|
| 6 | | →[M 3] | | [M 2] | | [M 1]→ | |
| 7 (4) | | [M 3] | | [M 2]→ | | →[M 2] | |

Note
door: open closed
substance: [ ]
→: transferring
M1: first substance
M2: second substance
M3: third substance
pressure: atmospheric pressure / low pressure / vacuum
(4) means step being similar to 4th.

TABLE 2

| Step No. | Charging Door 4 | Heating Chamber 1 | Intermediate vacuum Door 3 | Cooling Chamber 2 | Carriage Door 5 |
|---|---|---|---|---|---|
| 1 | | →[M 1] | | | |
| 2 | | [M 1] | | | |
| 3 | | [M 1]→ | | →[M 1] | |
| 4 | | →[M 2] | | [M 1] | |
| 5 | | [M 2] | | [M 1]→ | |
| 6 | | [M 2]→ | | →[M 2] | |

Note
door: open closed
Substance: [ ]
→: transferring
M1: first substance
M2: second substance
Pressure: atmospheric pressure / low pressure / Vacuum
(3) means step being similar to 3rd.

What is claimed is:

1. A semi-continuous vacuum heat-treating furnace comprising:

(a) a charging door and a carriage door installed respectively to charging and discharging ports at forward and rear sides of the furnace;

(b) a vacuum heating chamber constituted at front portion of the furnace, said vacuum heating chamber having a heating element and a heat insulation material both are stable in chemical property and strength in vacuum condition and atmospheric pressure at high temperature;

(c) a cooling chamber constituted at rear portion of the furnace; and (d) an intermediate vacuum door disposed within the furnace and for separating the vacuum heating chamber and the cooling chamber with each other.

2. A semi-continuous vacuum heat-treating furnace according to claim 1 wherein:

(a) heating power source, vacuum evacuating source and carburizing gas source are connected with said vacuum heating chamber, and (b) vacuum evacuating source and pressurized gas source are connected with said cooling chamber.

3. Operation process of a semi-continuous vacuum heat-treating furnace, said process comprising steps of:

(a) entering a first substance to a vacuum heating chamber in atmospheric pressure and then heating it to a prescribed temperature at vacuum condition;

(b) transferring the heated first substance to a cooling chamber at vacuum condition and cooling it at a prescribed cooling rate under pressure;

(c) enterring a second substance to the vacuum heating chamber at atmospheric pressure simultaneously with said cooling step of the first substance and then heating the second substance to a prescribed temperature at vacuum condition; and (d) restoring the cooling chamber to atmospheric pressure and discharging the first substance out of the furnace.

* * * * *